US010398964B2

(12) United States Patent
Long et al.

(10) Patent No.: US 10,398,964 B2
(45) Date of Patent: Sep. 3, 2019

(54) WHEEL CORE ASSEMBLY

(71) Applicants: Compagnie Generale des Etablissements Michelin, Clermont-Ferrand (FR); Michelin Recherche et Technique S.A., Granges-Paccot (CH)

(72) Inventors: Jay Reiss Long, Greenville, SC (US); Benjamin E. Ebel, Greenville, SC (US); Philippe Macherel, Fribourg (CH)

(73) Assignee: Compagnie Generale des Etablissements Michelin, Clermont-Ferrand (FR)

( * ) Notice: Subject to any disclaimer, the term of this patent is extended or adjusted under 35 U.S.C. 154(b) by 211 days.

(21) Appl. No.: 15/522,041

(22) PCT Filed: Aug. 6, 2015

(86) PCT No.: PCT/US2015/043912

§ 371 (c)(1),
(2) Date: Apr. 26, 2017

(87) PCT Pub. No.: WO2016/069081

PCT Pub. Date: May 6, 2016

(65) Prior Publication Data

US 2017/0326433 A1 Nov. 16, 2017

Related U.S. Application Data

(60) Provisional application No. 62/073,245, filed on Oct. 31, 2014.

(51) Int. Cl.
*A63C 17/22* (2006.01)
*A63C 17/01* (2006.01)

(52) U.S. Cl.
CPC ..... *A63C 17/223* (2013.01); *A63C 17/01* (2013.01); *A63C 17/017* (2013.01)

(58) Field of Classification Search
CPC ..... A63C 17/22; A63C 17/223; A63C 17/226; F16C 13/02; B60B 33/0028; B60B 33/0063
See application file for complete search history.

(56) References Cited

U.S. PATENT DOCUMENTS 344,453 A * 6/1886 Mendenhall ..... A63C 17/22 301/5.7
2,484,974 A 10/1949 Van Horn
(Continued)

FOREIGN PATENT DOCUMENTS

FR 2802990 6/2001

OTHER PUBLICATIONS

PCT International Search Report dated Oct. 23, 2015.

*Primary Examiner* — Jason R Bellinger
(74) *Attorney, Agent, or Firm* — Dority & Manning, P.A.

(57) ABSTRACT

A wheel core assembly for a recreational device such as a skateboard is provided. The orientation of the wheel core assembly can be readily reversed to allow use of both sides of a wheel such as e.g., a side-set wheel. The position of an outer bearing and a spacer can be readily switched to either side of an internal chamber thereby allowing the user to select the orientation of the wheel on an axle. The outer bearing and spacer can be configured for ready removal and installation without the use of special purpose tools.

17 Claims, 9 Drawing Sheets

(56) References Cited

U.S. PATENT DOCUMENTS

| | | | | | |
|---|---|---|---|---|---|
| 2,652,285 | A | | 9/1950 | Negri | |
| 2,622,930 | A | | 12/1952 | Negri | |
| 2,633,387 | A | | 3/1953 | Cooke | |
| 3,860,293 | A | * | 1/1975 | Labeda | A63C 17/223 301/5.7 |
| 4,114,952 | A | * | 9/1978 | Kimmell | A63C 17/01 301/108.5 |
| 4,218,098 | A | * | 8/1980 | Burton | A63C 17/223 152/323 |
| 4,531,785 | A | * | 7/1985 | Perkins | A63C 17/223 301/111.01 |
| 5,823,293 | A | | 10/1998 | Gilbertson | |
| 7,997,624 | B2 | | 8/2011 | Charell | |

* cited by examiner

WHEEL CORE ASSEMBLY

FIELD OF THE INVENTION

The subject matter of the present disclosure relates generally a wheel core assembly and, more particularly, to a wheel core assembly for a recreational device.

BACKGROUND OF THE INVENTION

Skateboards are commonly constructed as a board or platform connected with four wheels that are attached in pairs to axle assemblies sometimes referred to as "trucks." The user places one or both feet on the board while rolling under the force of gravity or self-propulsion. While skateboards can be used for transportation, skateboards are commonly ridden for recreational or sporting activities.

A variety of skateboard styles exist including different lengths, widths, and shapes depending upon e.g., the intended use or appeal to the rider. One type of skateboard, referred to as a longboard, uses a board having an increased length so as to extend the distance between the front pair of wheels and the rear pair of wheels. Longboards are often faster because of the wheel sizes used.

A popular sporting activity with skateboards, particularly the longboard variety, is referred to as sliding. In sliding, the rider intentionally causes the wheels to slide across a surface usually at a non-parallel angle to the rolling direction of the wheel. Wheels particularly formulated for sliding may be constructed from materials such as e.g., soft polyurethanes that facilitate sliding or skidding and may also leave marks on the ridden surface.

Typically, as the skateboard wheels are slid across surfaces in such manner, the wheels wear down as material is removed from their radially outermost contact surface. Over time, particularly for certain wheel types, the removal of material generally creates a cone-shaped wheel—i.e. a wheel having an increasing diameter along its axis of rotation in a direction from the inboard to the outboard side. This "coning" of the wheel can be accelerated by the use of softer materials for constructing the wheel and sliding as previously mentioned. Once the wheel has undergone a certain level of coning, the wheel may need replacement.

Alternatively, for certain wheel types, the user may be able to flip or reverse the orientation of the wheel on the axle and obtain extended use of the wheel. More particularly, three common types of skateboard wheels include center-set, off-set, and side-set. As will be understood by one of skill in the art, each type refers to a different location where weight is transferred to the wheel from the axle. This is typically determined the location of the bearings within the wheel. Center-set wheels, for example, typically have a bearing positioned near the center of the wheel, side-set wheels having a bearing located near the side of the wheel, and off-set wheels have a bearing located e.g., at about ⅔ the width of the wheel.

With center-set wheels in which the bearings supporting the axle are centrally located, once coning has occurred, the wheel can be flipped or reversed in orientation along the axle so as to balance the wear. For example, the wheel can be reversed to place the larger diameter side of coned wheel on the inboard side—i.e. on the side closest to the skateboard. This allows the rider to obtain extended life from the wheel. However, this procedure cannot be readily performed with side-set or off-set wheels because of the location of the bearings within the wheel prevents the wheel from being simply reversed and placed back onto the axle. Thus, after a certain amount of coning has occurred, these wheels typically must be replaced. Such replacement is particularly problematic because certain riders prefer side-set wheels—believing such orientation performs better for certain types of riding such as e.g., sliding. Worse, the side-set wheels are prone to coning more quickly than center-set wheels in certain skateboarding activities such as sliding.

Accordingly, a wheel core assembly for a skateboard that allows the wheel to be readily reversed or flipped in order to obtain extended usage of the wheel would be useful. Such a wheel core assembly that can be used with side-set wheels would be particularly useful. A wheel core assembly having these benefits that can also be readily flipped or reversed by the user without necessarily using special purpose tools would be also be particularly beneficial.

SUMMARY OF THE INVENTION

The present invention provides a wheel core assembly for a recreational device such as a skateboard. The orientation of the wheel core assembly can be readily reversed to allow use of both sides of a wheel such as e.g., a side-set wheel. The position of one or more bearings and a spacer can be readily switched to either side of an internal chamber thereby allowing the user to select the orientation of the wheel on an axle. One or more bearings and the spacer can be configured for ready removal and installation without the use of special purpose tools. Additional objects and advantages of the invention will be set forth in part in the following description, or may be apparent from the description, or may be learned through practice of the invention.

In one exemplary embodiment, the present invention provides a wheel core assembly defining a circumferential direction, an axial direction parallel to an axis of rotation about which the wheel core assembly rotates during use, and a radial direction that is orthogonal to the axial direction. The wheel core assembly includes a core that includes a radially outer mounting surface; an internal chamber extending along the axial direction between a pair of openings positioned along opposing sides of the core; a central bearing projection located in the internal chamber and extending radially inward; and a first outer bearing projection and a second outer bearing projection.

The first and second outer bearing projections are located on opposing sides of the central bearing projection and each extend radially inward. A first locking groove is positioned between the first bearing projection and the central bearing projection. The first locking groove has a cylindrically-shaped surface. A second locking groove is positioned between the second bearing projection and the central bearing projection. The second locking groove also has a cylindrically-shaped surface.

The wheel core assembly may include a wheel mounted on the radially outer mounting surface of the core. A spacer and one or more bearings can be provided for positioning within the internal chamber to receive an axle of a recreational device such as a skateboard.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 3, a bearing has been removed as compared to FIG. 1 in order to more clearly reveal certain internal features.

The use of the same reference numerals in different figures denotes the same or similar features as further described herein.

DETAILED DESCRIPTION

Figure 1:
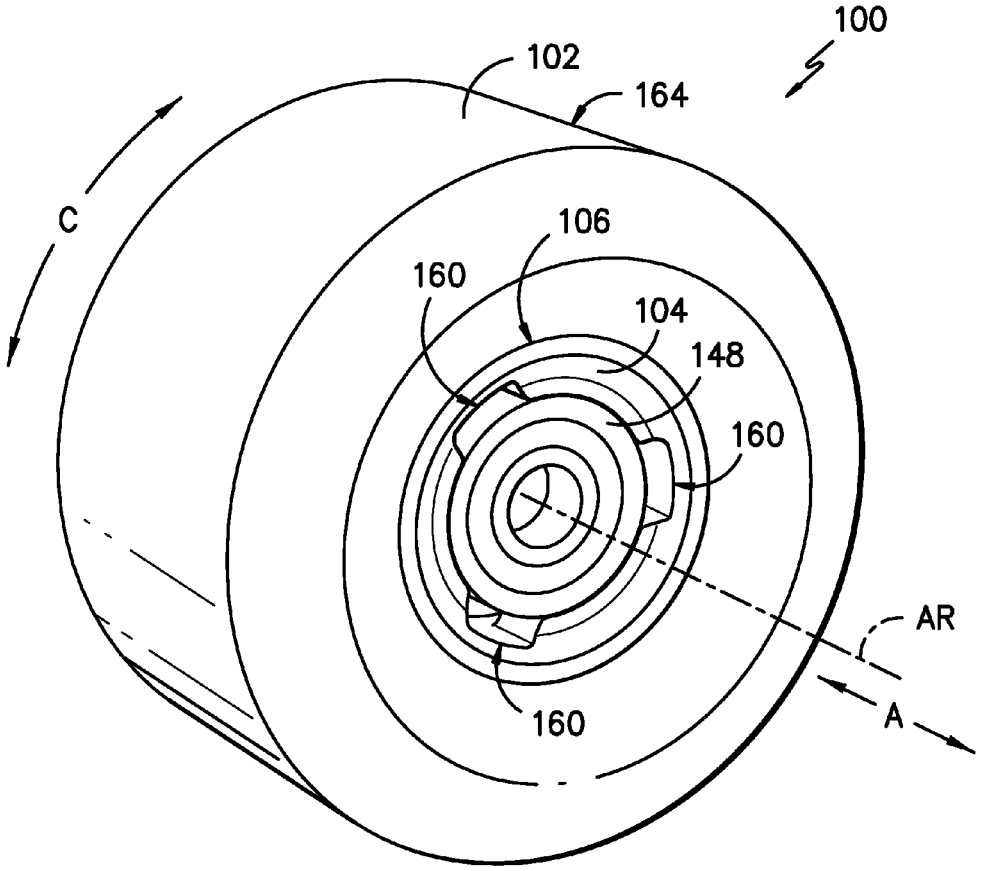
FIGS. 1 and 3 illustrate perspective views of an exemplary embodiment of the present invention.

For purposes of describing the invention, reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

Figure 2:
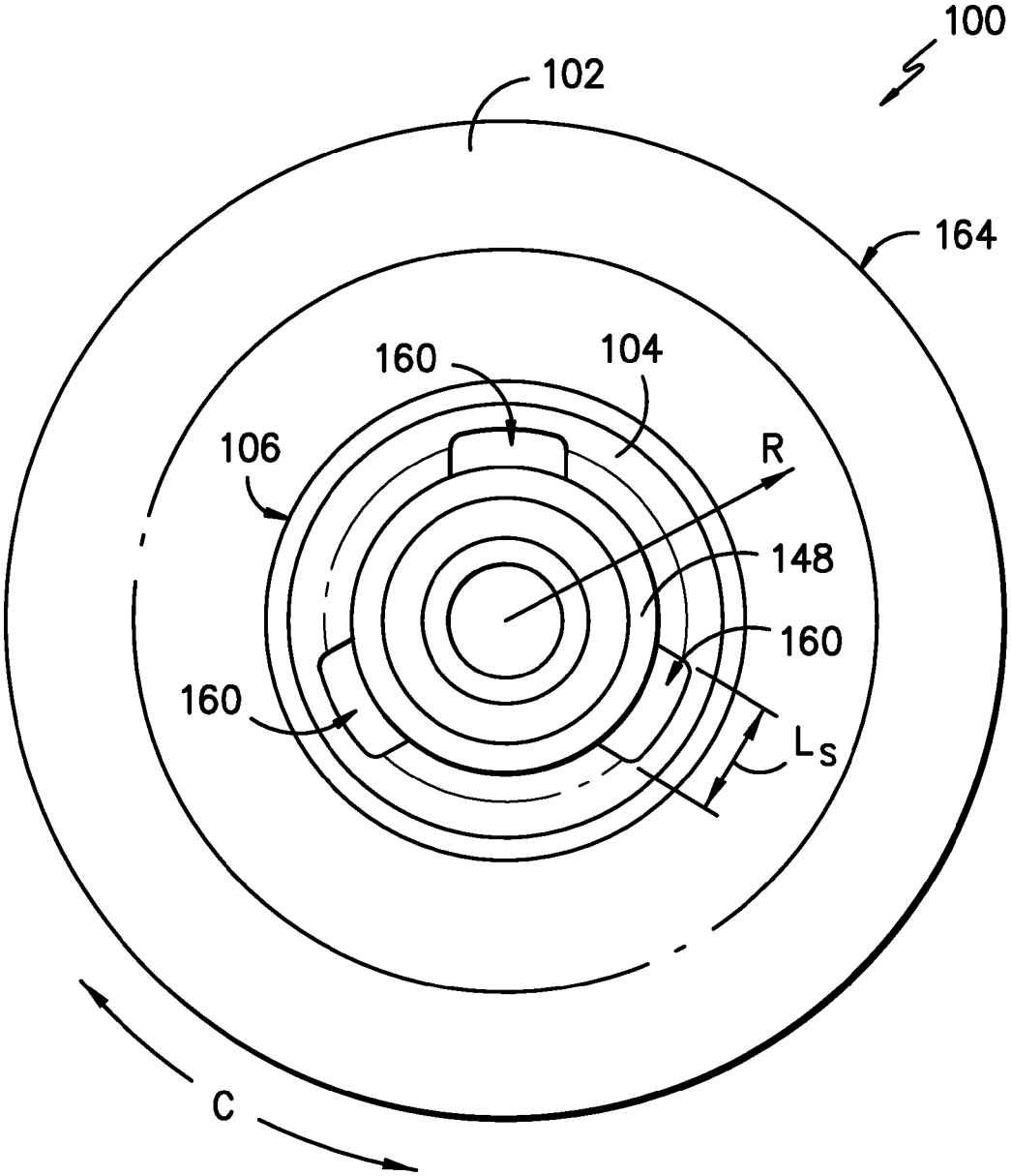
FIG. 2 provides a side view of the exemplary embodiment of FIGS. 1 and 2. For this exemplary embodiment, the appearance of both side views is basically identical.
Figure 3:
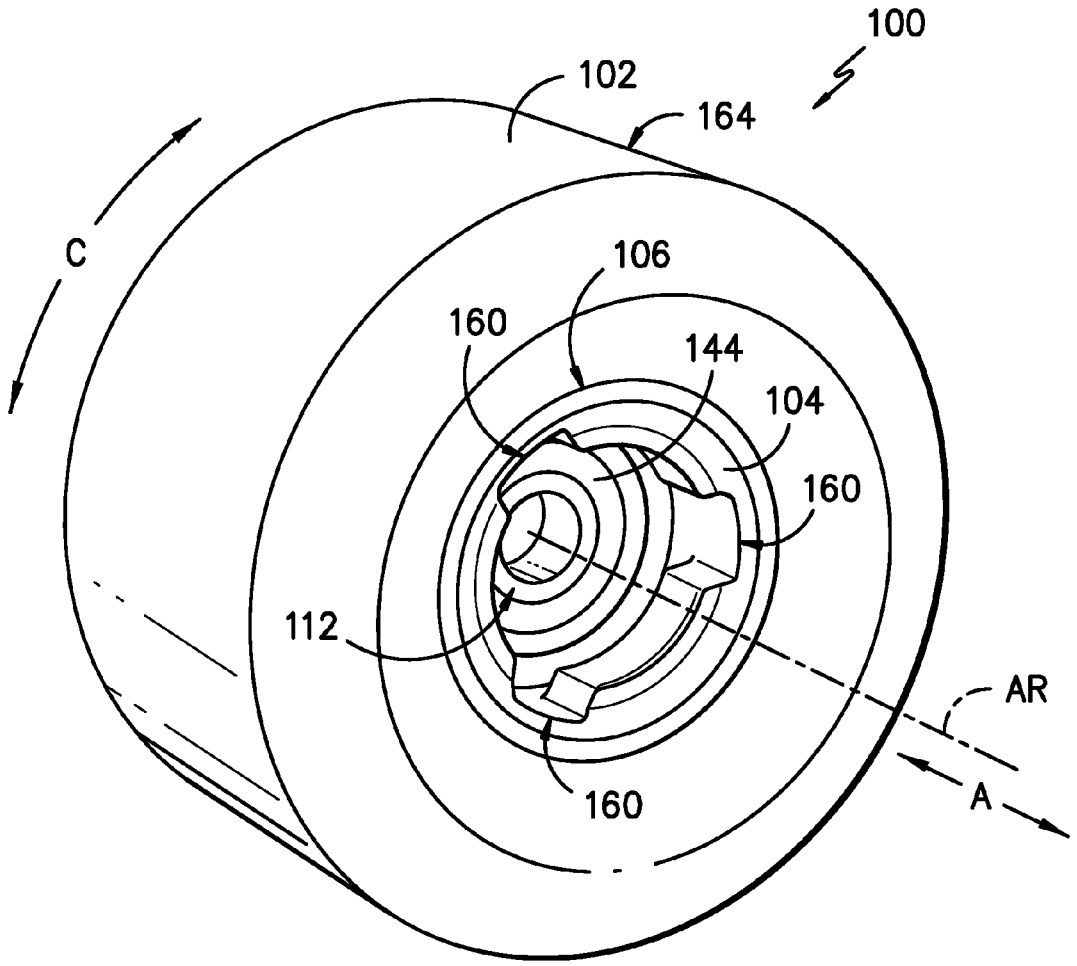
Figure 4:
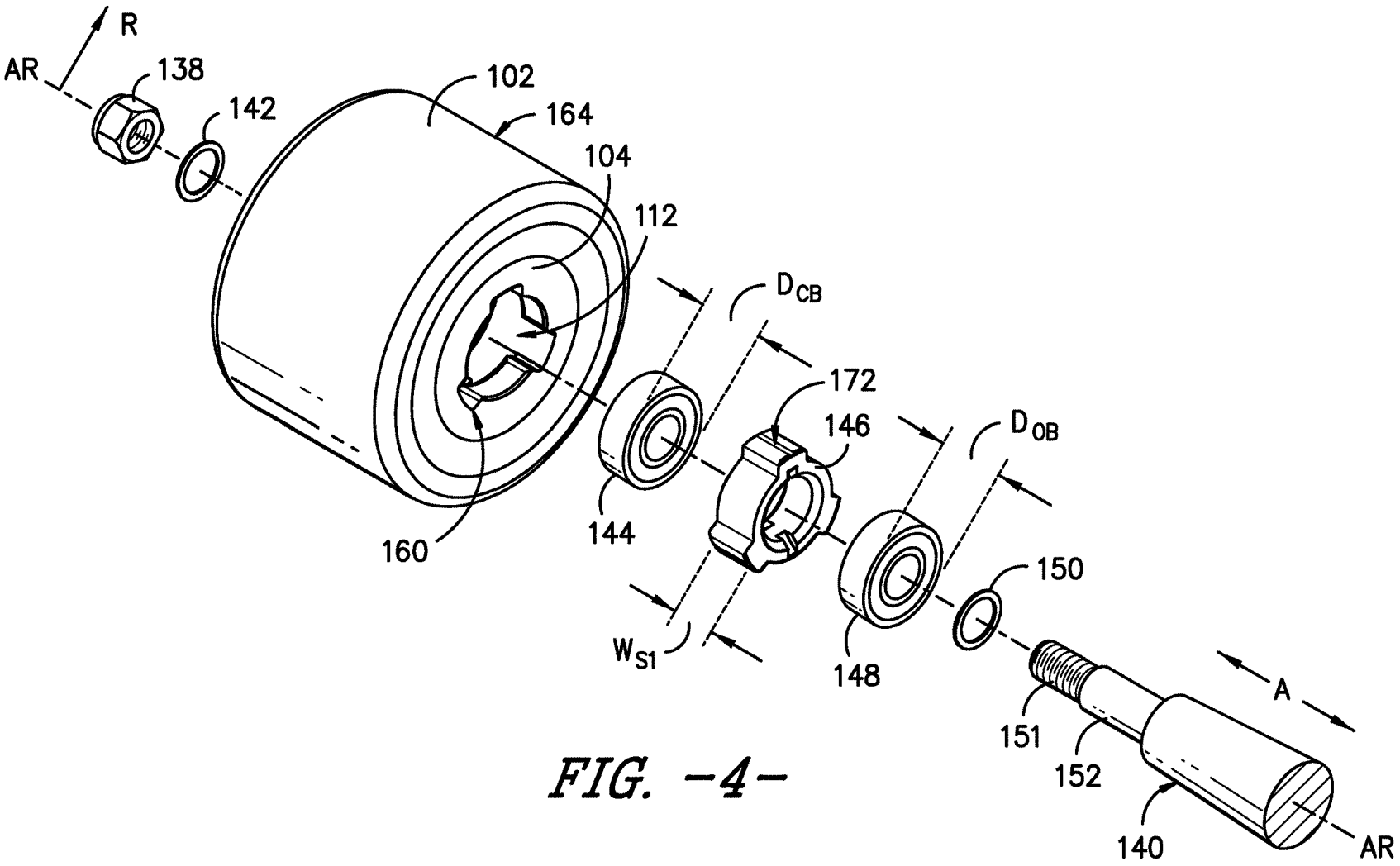
FIG. 4 is an exploded, perspective view of the exemplary embodiment of FIGS. 1, 2, and 3.

FIGS. 1, 2, and 3 provide perspective and side views of an exemplary embodiment of a wheel core assembly 100 of the present invention while FIG. 4 provides an exploded view of the same. For this embodiment, wheel core assembly 100 includes a wheel 102 mounted onto a radially outer mounting surface 106 of a core 104. In other embodiments, assembly 100 may be provided without wheel 102 such that the end user or an assembler can mount a wheel 102 of choice onto core 104.

Wheel core assembly 100 defines a circumferential direction C that is circular and e.g., tangent to a ground contacting surface at the point of contact with wheel 102. Wheel core assembly 100 also defines an axial direction A that is parallel to the axis of rotation AR about which wheel 102 rotates during use. A radial direction R extends orthogonally to axial direction A.

A variety of materials may be used for the construction of wheel core assembly 100 and different materials may be used e.g., for wheel 102, core 104, and other components. In one exemplary embodiment, core 104 is constructed from a plastic such as polyethylene terephthalate (PET) whereas wheel 102 is constructed from a relatively softer polyurethane as may be preferable for some skateboarding activities such as e.g., sliding. Other materials such as metal, polyurethanes, and other plastics may also be utilized for assembly 100.

Figure 10:
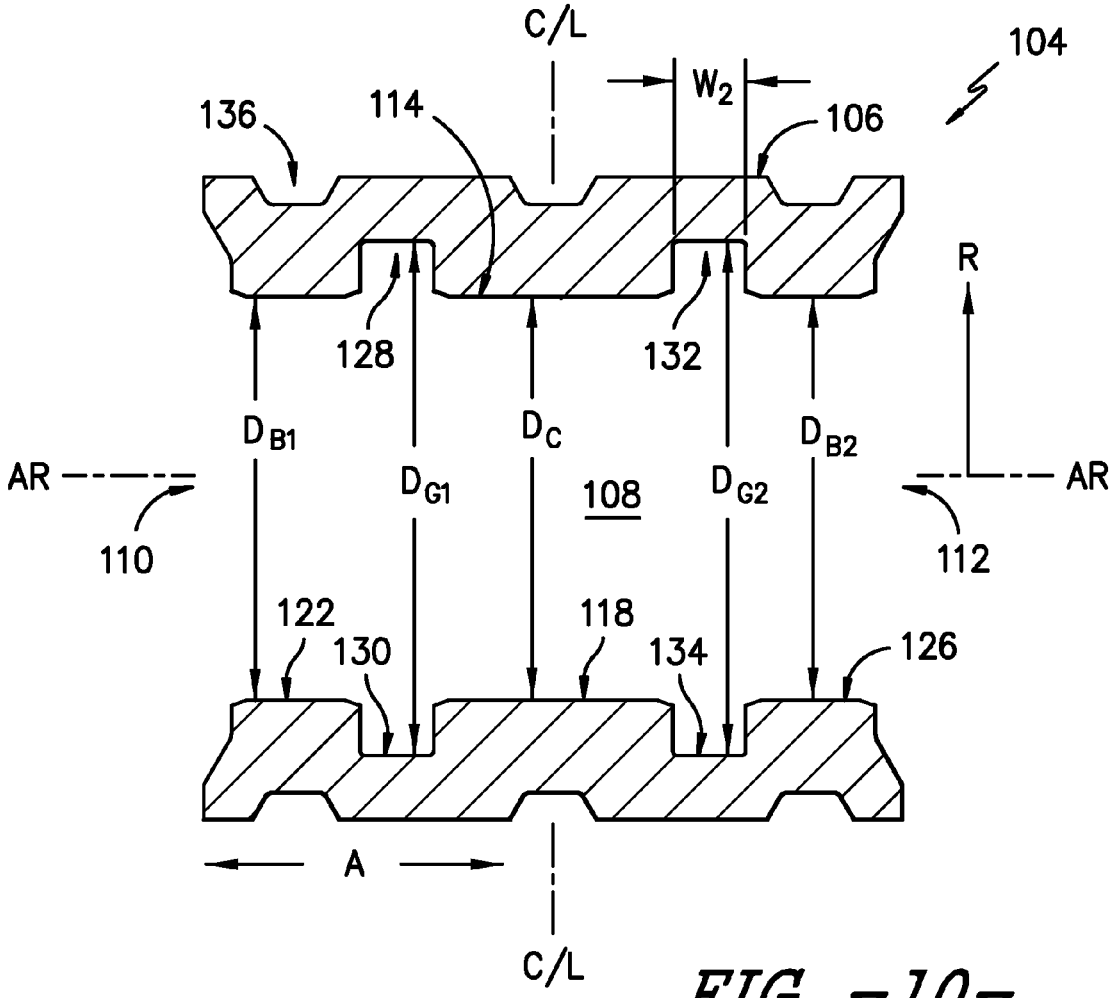
FIG. 10 is cross-sectional view of the exemplary core used in the embodiment of FIGS. 8 and 9.

Wheel core assembly 100 can be removably mounted onto an axle 152 of a skateboard or other recreational device. A central bearing 144 and outer bearing 148 are separated by a spacer 146 and are all removably received onto axle 152 and are positioned within an internal chamber 108 (FIGS. 6 and 10) of core 104. For the orientation of assembly 100 shown in FIG. 4, washer 150 is removably positioned along the inboard side of axle 152. Washer 142 and fastener 138 are removably positioned along the outboard side of axle 152 onto threads 151 and secure wheel core assembly 100 to axle 152. Spacer 146 maintains the position of bearings 144 and 148 relative to each other within internal chamber 108.

Accordingly, if a user desires to reverse the orientation of wheel core assembly 100 on axle 152, fastener 138 can be readily removed from threads 151 so that wheel core assembly 100 can be reversed or flipped over and placed back onto axle 152 after relocating spacer 146 and outer bearing 148 as will be further described. The present invention is not limited to fastener 138 and threads 151 and other mechanisms for removably securing wheel core assembly 100 may be used as well.

Figure 5:
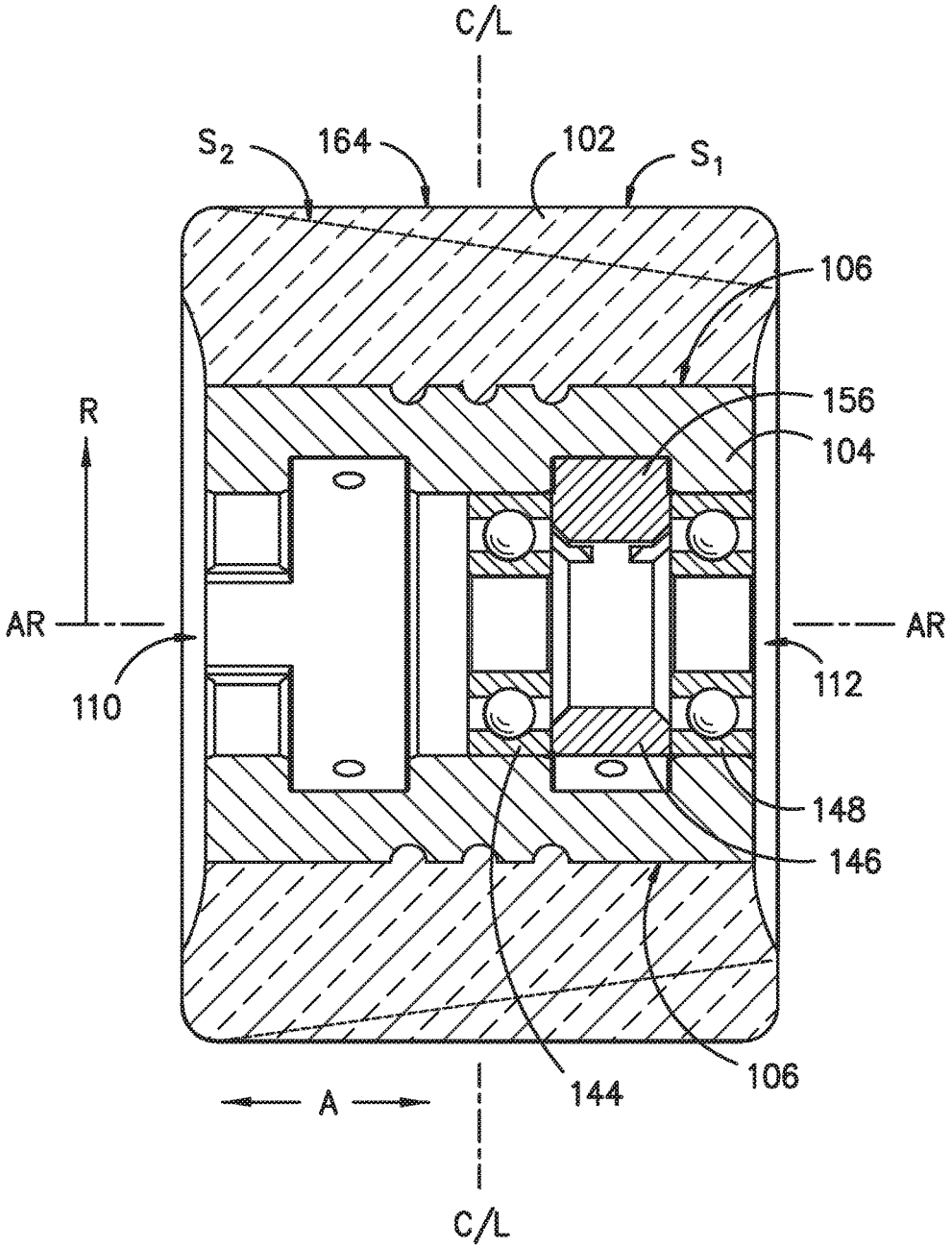
FIG. 5 is a cross-sectional view of the exemplary embodiment of FIGS. 1, 2, 3, and 4.
Figure 6:
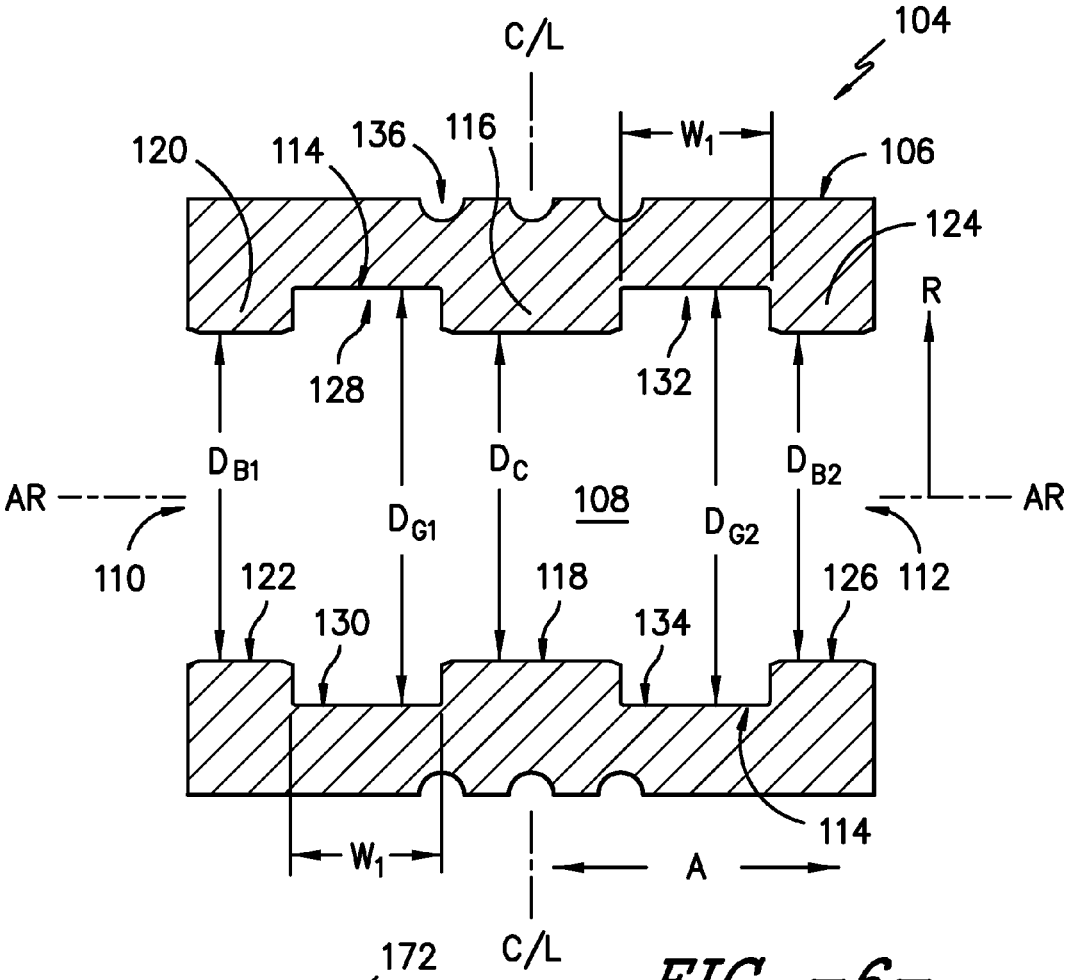
FIG. 6 is cross-sectional view of the exemplary core used in the embodiment of FIGS. 1, 2, 3, 4 and 5.

Referring now to FIGS. 5 and 6, this exemplary core 104 of wheel core assembly 100 defines radially outer mounting surface 106. Grooves 136 on surface 106 can be used to assist in securing a wheel 102 onto core 104. Core 104 also defines an internal chamber 108 with inner surface 114. Internal chamber 108 extends along axial direction A between a pair of openings 110 and 112. As shown, openings 110 and 112 are spaced apart along axial direction A and are positioned along opposing sides of core 104. In FIG. 4, opening 112 is shown in an inboard orientation such that opening 112 is facing or adjacent to shoulder 140 of axle 152. However, as stated above, the present invention allows wheel core assembly 100 to be readily reversed or flipped such that opening 110 is in an inboard orientation with opening 110 facing or adjacent to shoulder 140 of axle 152.

Continuing with FIGS. 5 and 6, core 104 includes a cylindrically-shaped central bearing projection 116 that extends radially inward into internal chamber 108 and defines central bearing surface 118 (FIG. 6). For this exemplary embodiment, central bearing projection 116 is positioned along a centerline C/L of wheel core assembly 100. Central bearing surface 118 is cylindrically-shaped and has an inner diameter $D_C$ that is along or parallel to radial direction R. Diameter $D_C$ matches the outer diameter $D_{CB}$ (FIG. 4) of a central bearing 144. As used herein, "match" or "matches" means that diameters $D_C$ is about the same or only slightly larger than diameter $D_{CB}$ such that central bearing 144 can be removably positioned onto central bearing surface 118 (FIG. 5) by pressing or pulling into position, and central bearing 144 is held into place on surface 118 by an interference fit as will be understood by one of ordinary skill in the art.

Core 104 includes a cylindrically-shaped first outer bearing projection 120 that extends radially inward into internal chamber 108, and defines a first outer bearing surface 122 (FIG. 6). For this exemplary embodiment, first outer bearing projection 120 is positioned adjacent opening 110 and along one side of centerline C/L of wheel core assembly 100. First outer bearing projection 122 is cylindrically-shaped and has an inner diameter $D_{B1}$ along or parallel to radial direction R. Diameter $D_{B1}$ matches the outer diameter $D_{OB}$ (FIG. 4) of outer bearing 148. As such, outer bearing 148 can be removably positioned onto first outer bearing surface 122 by pressing or pulling into position and is held into place on surface 122 by an interference fit as will be understood by one of ordinary skill in the art.

Core 104 also includes a cylindrically-shaped second outer bearing projection 124 that extends radially inward into internal chamber 108, and defines a second outer bearing surface 126 (FIG. 6). For this exemplary embodiment, second outer bearing projection 124 is positioned adjacent opening 112 and along one side of centerline C/L of wheel core assembly 100 opposite to first outer bearing projection 120 with central bearing projection 116 located therebetween. Second outer bearing projection 124 is cylindrically-shaped and has an inner diameter $D_{B2}$ (along or parallel to radial direction R). Diameter $D_{B2}$ matches the outer diameter $D_{OB}$ (FIG. 4) of outer bearing 148. As such, outer bearing 148 can be removably positioned onto second outer bearing surface 126 as shown in FIG. 5 by pressing or pulling into position and is held into place on surface 126 by an interference fit as will be understood by one of ordinary skill in the art.

Figure 7:
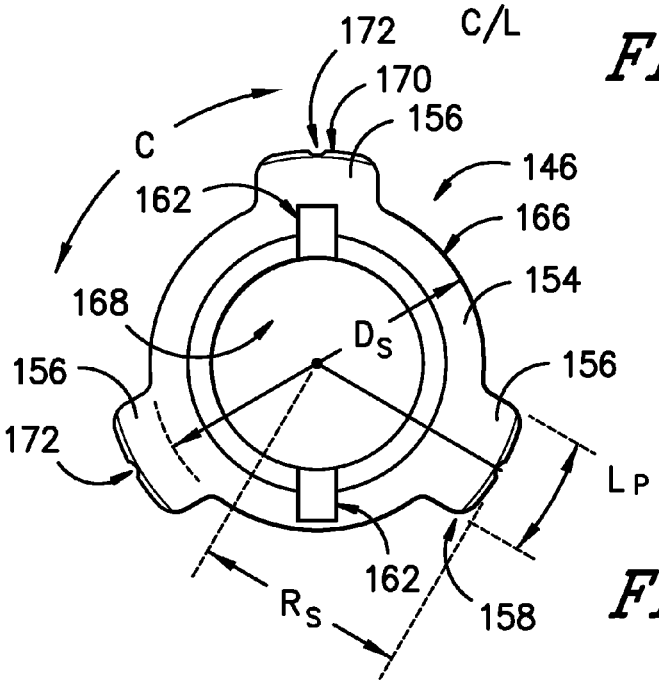
FIG. 7 is an exemplary embodiment of a spacer of the present invention.

As shown in FIGS. 5 and 6, core 104 defines a cylindrically-shaped first locking groove 128 that is configured for the receipt of removable spacer 146. Along axial direction A, first locking groove 128 is positioned between central bearing projection 116 and first outer bearing projection 120. First locking groove 128 defines a cylindrically-shaped first locking groove surface 130 having an inner diameter $D_{G1}$ (along or parallel to radial direction R). Diameter $D_{G1}$ is of a magnitude that will allow spacer 146 to be rotated along circumferential direction C within first locking groove 128. As such, diameter $D_{G1}$ is matched to about twice the magnitude of radius $R_s$ of spacer 146 as depicted in FIG. 7. Additionally, for his exemplary embodiment, diameter $D_{G1}$ is greater than diameter $D_C$ and diameter $D_{B1}$.

Core 104 defines a cylindrically-shaped second locking groove 132 that is also configured for the receipt of removable spacer 146 (shown in this position in FIG. 5). Along axial direction A, second locking groove 132 is positioned between central bearing projection 116 and second outer bearing projection 124. Second locking groove 132 defines a cylindrically-shaped second locking groove surface 134 having an inner diameter $D_{G2}$ (along or parallel to radial direction R). Diameter $D_{G2}$ is of a magnitude that will allow spacer 146 to be rotated along circumferential direction C within second locking groove 132. As such, diameter $D_{G2}$ is matched to about twice the magnitude of radius $R_s$ of spacer 146 as depicted in FIG. 7. Additionally, for this exemplary embodiment, diameter $D_{G2}$ is greater than diameter Dc and diameter $D_{B2}$.

Referring to FIG. 7, spacer 146 includes a ring-shaped portion or ring 154 having a radially outer surface 166. For this exemplary embodiment, spacer also has three projections 156 extending radially outward from surface 166 and uniformly spaced apart along circumferential direction C. Although three projections 156 are shown, in other exemplary embodiments, one, two, four, or more projections may be used.

Ring 154 defines an opening 168 through which axle 152 can extend. A pair of notches 162 are positioned in an opposing manner about opening 168. Notches 162 may be used to rotate ring 154 along circumferential direction C within grooves 128 and 132 of internal chamber 108 as will be further described below. While two notches 152 are shown, one or more than two notches may be used as well.

Spacer 146 has a radius $R_s$ extending from the center of spacer 146 to the radially outer surface 170 of distal end 158 of projection 156. As stated above, diameter $D_{G1}$ and diameter $D_{G2}$ of core 104 are matched to about twice the magnitude of radius $R_s$ (FIG. 7). Ring 154 of spacer 146 has a diameter $D_S$. The magnitude of diameter $D_S$ allows spacer 146 to be moved along axial direction A within internal chamber 108. For example, diameter $D_S$ is the same or slightly less than diameter $D_{B1}$ or diameter $D_{B2}$ such that spacer 146 can be inserted into opening 110 or 112, past outer bearing projections 120 or 124, and into a position within locking groove 128 or 132.

As best viewed in FIGS. 1 through 4, the outer bearing projections 120 and 124 each define three slots 160 that are uniformly spaced about circumferential direction C. Each slot 160 has a width along axial direction A equal to the axial width of projection 120 or 124 (FIG. 6) respectively. Each slot 160 also has a length $L_S$ (FIG. 2) along circumferential direction C that is about the same or greater than the length $L_P$ (FIG. 7) along circumferential direction C of a projection 156 on spacer 146. As such, by aligning projections 156 with slots 160, spacer 146 can be moved along axial direction A into internal chamber 108 and into locking groove 128 or 132.

Once positioned into complementary receipt with either locking groove 128 or 132, spacer 146 can be rotated clockwise or counter-clockwise along circumferential direction C so as to fix the position of spacer 146 within core 104 by moving projections 156 out of axial alignment with slots 160. Referring to FIGS. 4 and 6, spacer 146 has a width $W_{S1}$ that matches the width $W_1$ of locking groove 128 or 132 so that such rotation is facilitated while allowing the circumferential position of spacer 146 to be fixed. Conversely, spacer 146 can be rotated again to align projections 156 with slots 160 along axial direction A such that spacer 146 can be moved along axial direction A for removal from inner chamber 108 of core 104.

An exemplary method of using wheel core assembly 100 will now be described—it being understood that other methods with different steps or sequencing of such steps may also be used.

By way of example, after a period of use, wheel 102 of assembly 100 may lose some of its outer surface 164. Referring to FIG. 5, the profile may change from the relatively flat profile $S_1$ of a new wheel to the conical profile $S_2$—particularly when opening 112 is positioned to the inboard side of the skateboard (i.e. adjacent to shoulder 140 of axle 152). In such orientation, axle 152 rides on outer bearing 148 that is positioned on second outer bearing surface 126 and central bearing 144 that is positioned on central bearing surface 118. Once wear creates conical surface $S_2$, the user may desire to flip or reverse wheel core assembly 100 such that opening 110 is adjacent to the inboard side of the skateboard (i.e. adjacent to shoulder 140 of axle 152) and thereby reverse the conical profile.

Accordingly, referring generally to FIGS. 1-7, in order to reverse wheel core assembly 100, fastener 138 is removed and wheel core assembly 100 is slid off axle 152 (FIG. 4) Next, outer bearing 148 is removed from second outer bearing surface 126 of projection 124 through opening 112. Removable spacer 146 is rotated within second locking groove 132. This step may be performed without special purpose tools. For example, a coin, conventional screw driver, or other edge may be inserted into notches 162 and used to rotate spacer 146 so as to align projections 156 with slots 160 in second outer bearing projection 124. Such alignment allows spacer 146 to be removed along axial direction A from internal chamber 106 through opening 112. In other embodiments of the invention, spacer 146 could be equipped for rotation by use of special purpose tools—but this may be undesirable for certain users.

Spacer 146 is now inserted into internal chamber 108 through opening 110. As previously indicated, this requires aligning projections 156 with slots 160 in first outer bearing projection 120 so that spacer 146 may be moved along axial direction A into position within first locking groove 130. Spacer 146 is now rotated so that projections 156 and slots 160 are no longer aligned along axial direction A, which in effect locks the position of spacer 146. Again, notches 162 may be used to effect this rotation.

Next, outer bearing 148 is inserted through opening 110 onto the first outer bearing surface 122 of first outer bearing projection 120. The resulting assembly 100 may now be replaced onto axle 152 by inserting axle 152 through outer bearing 148, spacer 146, and central bearing 144 within core 100. With opening 110 now positioned against or adjacent to shoulder 140, the orientation of wheel core assembly 100 has been reversed or flipped, and the user or rider may now obtain extended life from wheel 102.

Notably, for this exemplary method and embodiment, it is unnecessary to remove central bearing 144. Central bearing 144 may require sliding a small distance along axial direction A towards opening 110 so as to make contact with spacer 146 when the orientation of assembly 100 is reversed. Such sliding can be accomplished directly or by the tightening of fastener 138. In other embodiments of the invention, central bearing 144 may remain removable or may be fixed into position on central bearing projection 116.

FIGS. 8 through 11 illustrates still another exemplary embodiment of a wheel core assembly 100 of the present invention where the use of the same or similar reference numerals as used in FIGS. 1 through 7 denotes the same or similar features. Wheel core assembly 100 in FIGS. 8 through 11 is similar in structure and operation to that of the previous exemplary embodiment except for first and second locking grooves 130 and 134 as well as spacer 146.

Figure 11:
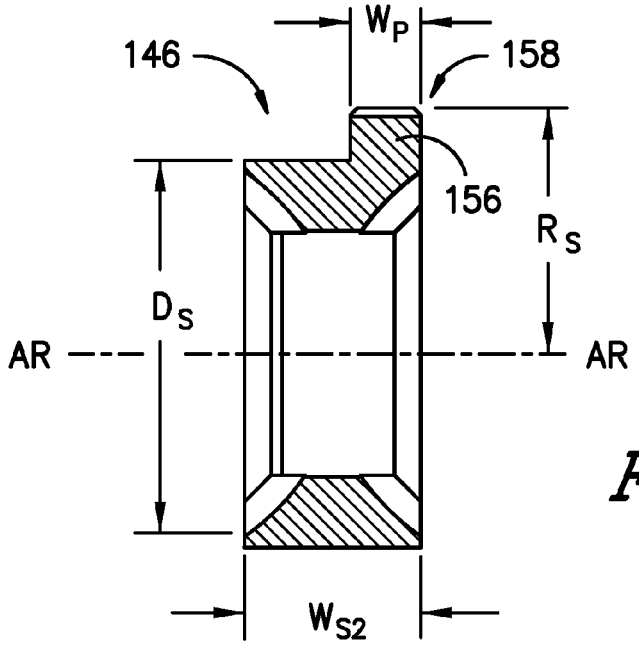
FIG. 11 is cross-sectional, side view of another exemplary embodiment of a spacer of the present invention.

More particularly, spacer 146 of FIGS. 8 through 11 has three projections 156 equally spaced about circumferential direction C as with the previous embodiment. However, as shown in FIG. 11's cross-sectional side view of spacer 146, projections 156 have a width $W_P$ along axial direction A that is less than the overall width $W_{S2}$ of spacer 146 along axial direction A. Width $W_P$ of projections 156 is the same or less than the width $W_2$ (FIG. 10) along axial direction A of each of first locking grove 128 and second locking groove 132. Notably, the overall width $W_{S2}$ of spacer 146 is greater than the width along axial direction A of each of first locking groove 128 and second locking groove 132. By controlling the relative widths of $W_P$ and $W_{S2}$, this exemplary embodiment of spacer 146 allows e.g., additional control over the placement of central bearing 144 within internal chamber 108.

For this embodiment, during the process of reversing assembly 100, central bearing 144 is slid along axial direction A by a small distance towards opening 110 or 112 at the same time, or prior to, insertion of spacer 146 into internal chamber 108. Such sliding can be performed directly or by contact with spacer 146 when it is inserted into chamber 108. The method of reversing or flipping wheel core assembly 100 of FIGS. 8 through 11 is otherwise similar to that previously described for the embodiments of FIGS. 1 through 7.

Figure 8:
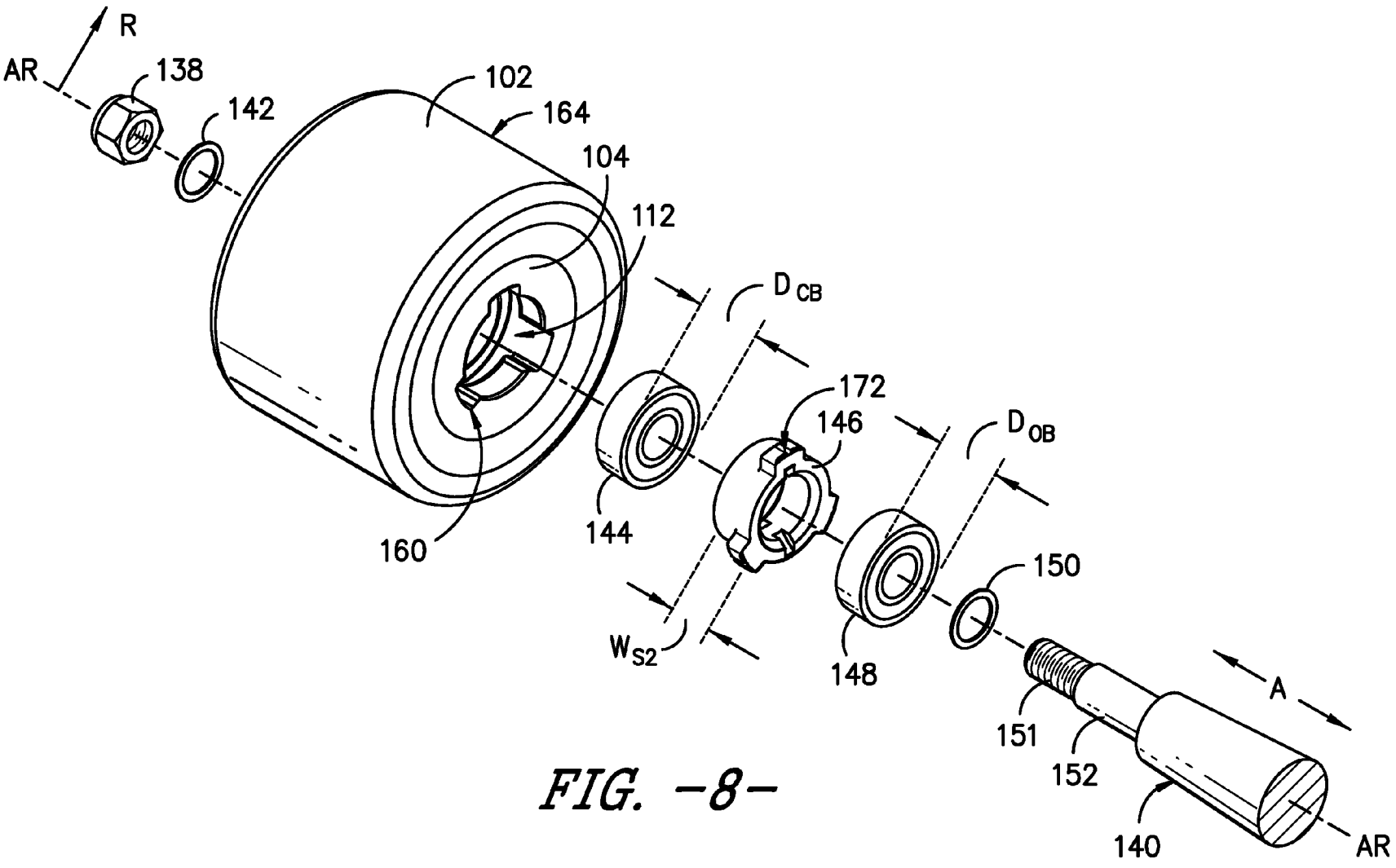
FIG. 8 is an exploded, perspective view of another exemplary embodiment of the present invention.
Figure 9:
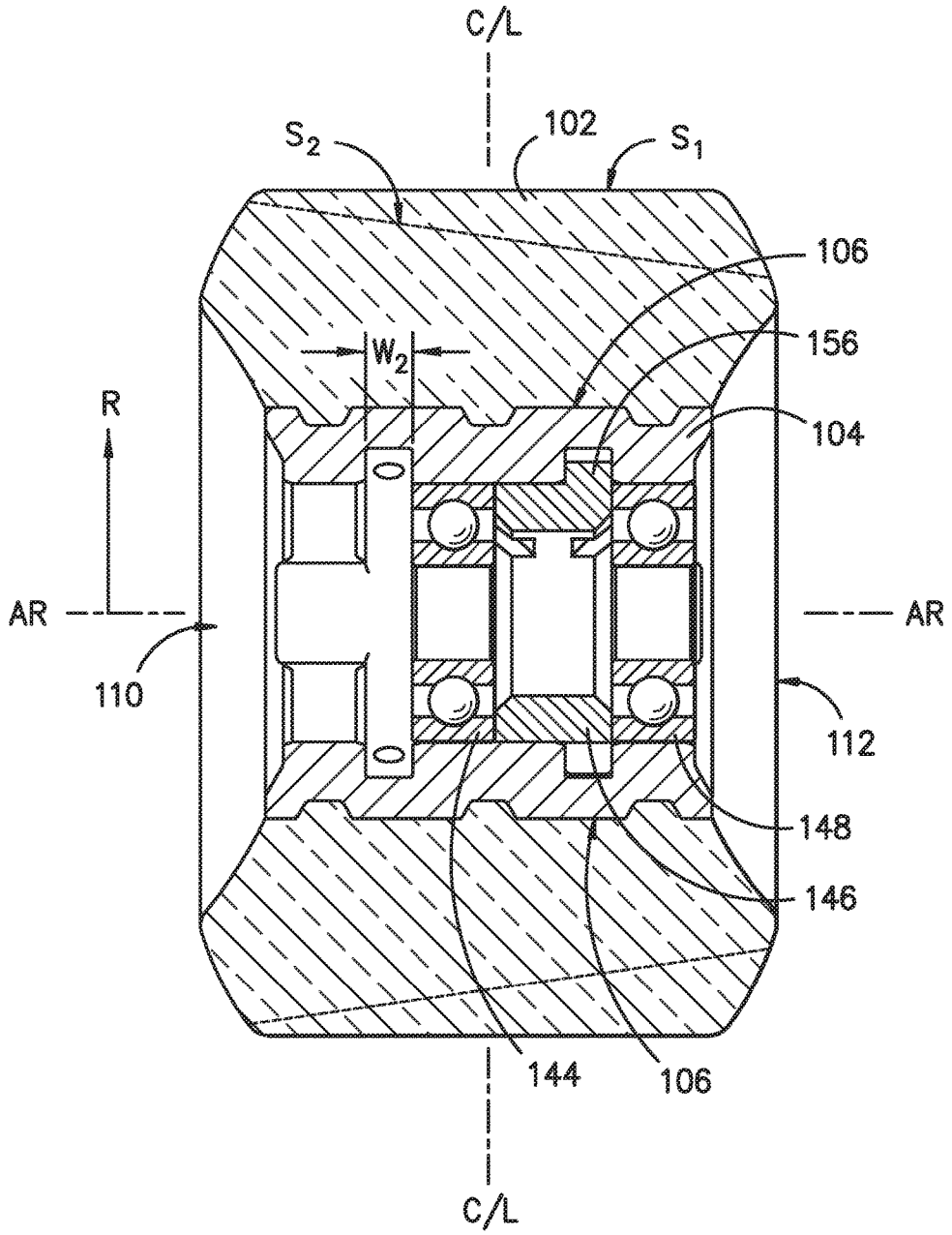
FIG. 9 is a cross-sectional view of the exemplary embodiment of FIG. 8.

In certain embodiments, spacer 146 may include a groove 172 on distal end 158 of projection 156 as shown e.g., in FIGS. 4, 6, and 8. Groove 172 can be used to assist in locking spacer 146 into place after it has been rotated into position in either of grooves 128 or 132. Groove 172 cooperates with convex counter-shape such as a ridge or projection (not shown) located on surfaces 130 and 134. The material used for spacer 146 and/or core 104 can provide elasticity for a clip effect to keep spacer 146 locked against rotation until intentionally rotated by the user during removal.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A wheel core assembly defining a circumferential direction, an axial direction parallel to an axis of rotation about which the wheel core assembly rotates during use, and a radial direction that is orthogonal to the axial direction, the wheel core assembly comprising:

a core comprising a radially outer mounting surface;

an internal chamber extending along the axial direction between a pair of openings positioned along opposing sides of the core;

a central bearing projection located in the internal chamber and extending radially inward;

a first outer bearing projection and a second outer bearing projection, the first and second outer bearing projections located on opposing sides of the central bearing projection and each extending radially inward;

a first locking groove positioned between the first bearing projection and the central bearing projection, the first locking groove having a cylindrically-shaped surface;

a second locking groove positioned between the second bearing projection and the central bearing projection, the second locking groove having a cylindrically-shaped surface; and a removable spacer comprising a ring having at least one projection extending outwardly along the radial direction from the ring, the spacer configured for complementary receipt into either the first locking groove or second locking groove.

2. The wheel core assembly of claim 1, wherein the at least one projection of the removable spacer has a distal end having a length along the circumferential direction, and wherein the first and second outer bearing projections each define a slot extending along the axial direction, the slot having a length along the circumferential direction that matches the length along the circumferential direction of the at least one projection of the spacer.

3. The wheel core assembly of claim 1, wherein the ring and projection of the spacer each have a width along the axial direction that matches a width along the axial direction of the first locking groove or the second locking groove.

4. The wheel core assembly of claim 1, wherein the spacer has a width along the axial direction that is wider than a width along the axial direction of each of the first locking groove, the second locking groove, and the projection.

5. The wheel core assembly of claim 1, wherein the ring of the spacer defines at least one notch configured to facilitate removal of the spacer from the internal chamber.

6. The wheel core assembly of claim 1, wherein the ring of the spacer defines a pair of notches positioned an opposing manner about an opening of the ring and configured to facilitate removal of the spacer from the internal chamber.

7. The wheel core assembly of claim 1, a removable spacer comprising a ring having three projections extending outwardly along the radial direction from the ring, the spacer configured for complementary receipt into either the first locking groove or second locking groove.

8. The wheel core assembly of claim 7, wherein the projections are equally spaced about a circumferential direction of the ring.

9. The wheel core assembly of claim 7, wherein the first and second outer bearing projections each define three slots extending along the axial direction, spaced-apart along the circumferential direction, and each having a length along the circumferential direction that matches a length along the circumferential direction of one of the three projections of the spacer.

10. The wheel core assembly of claim 9, wherein the three slots are uniformly spaced apart from each other along the circumferential direction.

11. The wheel core assembly of claim 1, further comprising an outer bearing having an outer diameter that matches a diameter along the radial direction of the first bearing projection or the second bearing projection, the outer bearing removably positioned on the first bearing projection or the second bearing projection.

12. The wheel core assembly of claim 1, further comprising a central bearing having an outer diameter that matches a diameter along the radial direction of the central bearing projection, the central bearing positioned on the central bearing projection.

13. The wheel core assembly of claim 12, wherein the central bearing is removably positioned on the central bearing projection.

14. The wheel core assembly of claim 10, wherein the first and second bearing projections and the central bearing projection have equal diameters along a radial direction.

15. The wheel core assembly of claim 14, wherein the first locking groove and the second locking groove each have equal diameters along a radial direction.

16. The wheel core assembly of claim 15, wherein the diameters of the first locking groove and the second locking groove are greater than the diameters of the first and second bearing projections and the central bearing projection.

17. The wheel core assembly of claim 15, further comprising a wheel positioned on the radially outer mounting surface of the core.

* * * * *